US006089048A

United States Patent [19]

Lonati et al.

[11] Patent Number: 6,089,048

[45] Date of Patent: Jul. 18, 2000

[54] YARN FEEDER FOR LENGTHENING YARN PATH OF HIGH ELONGATION YARNS IN CIRCULAR KNITTING MACHINES

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/081,213

[22] Filed: May 20, 1998

[30] Foreign Application Priority Data

Jun. 22, 1997 [IT] Italy ..... MI97A1295

[51] Int. Cl.[7] ..... D04B 15/60; D04B 15/46

[52] U.S. Cl. ..... 66/134

[58] Field of Search ..... 66/134, 140 R

[56] References Cited

U.S. PATENT DOCUMENTS

| | | | |
|---|---|---|---|
| 2,259,375 | 10/1941 | Grothey et al. | 66/134 |
| 2,377,729 | 6/1945 | Toone et al. | 66/134 |
| 3,017,757 | 1/1962 | Moyer | 66/146 |
| 3,522,149 | 7/1970 | Lonati | 66/134 |

FOREIGN PATENT DOCUMENTS

| | | |
|---|---|---|
| 2282009 | 8/1970 | France . |
| 1900722 | 8/1970 | Germany . |
| 1635766 | 6/1971 | Germany . |
| 2507815 | 9/1975 | Germany . |

*Primary Examiner*—Andy Falik
*Attorney, Agent, or Firm*—Guido Modiano; Albert Josif; Daniel O'Byrne

[57] ABSTRACT

A yarn feeder, particularly for elastic yarns having a high elongation coefficient, in circular knitting machines. The feeder comprises a series of passages and/or contact regions forming a path for the yarn that unwinds from the spool or reel up to the needle work area of the machine. The feeder comprises, along the path, an element which can engage the yarn and can move on command in order to lengthen the yarn path so as to produce an excess length of yarn unwound from the spool with respect to the length of yarn required by the machine and so as to supply at least part of the excess yarn directly before yarn cutting, which is performed proximate to the needle work area of the machine.

18 Claims, 2 Drawing Sheets

YARN FEEDER FOR LENGTHENING YARN PATH OF HIGH ELONGATION YARNS IN CIRCULAR KNITTING MACHINES

BACKGROUND OF THE INVENTION

The present invention relates to a yarn feeder particularly for yarns with high elongation coefficient in circular knitting machines for stocking or hosiery-making.

In conventional circular knitting machines, particularly single-cylinder machines, the yarns used to form items are dispensed, proximate to the needle work area, at specific regions of the machine, commonly known as drops or feeds, by means of suitable yarn fingers. When knitting produced with one yarn is complete, the corresponding yarn finger is moved into such a position as to prevent the needles of the machine from taking up the yarn and said yarn, which remains hooked on the last needle that took it up, is located above the dial having a suitable cutter to cut the yarn.

Above the dial, which rotates rigidly with the needle cylinder, there is provided a knife which is connected to the dial supporting structure and thus remains fixed while the dial rotates. The knife can be actuated on command so as to act as complementary cutting edge for the cutter, cutting the yarn when it passes below the knife, between said knife and the cutter. A suction port is arranged between the region occupied by the yarn fingers and the region occupied by the knife, above the dial; said port is meant to aspirate and retain the yarn after it has been cut by the combined action of the knife and the cutter.

In knitting with elastic yarns having a high elongation coefficient, which are usually fed to needles with a certain degree of pretensioning, such as for example in the case of elastic yarns made of a material commercially known by the trade-name Lycra, it is rather difficult to achieve correct suction of the end of the yarn, after cutting, by the suction port. Said yarns in fact shorten considerably once cut, due to their elasticity, and it is therefore difficult for the suction port to aspirate them. If the yarn is not aspirated, it tends to retract and shorten towards the yarn finger and to slip out of it, interrupting the operation of the machine when the yarn must be fed again to the needles of the machine.

In order to solve this problem, it has been suggested to use, proximate to the knife, a clamp which can retain the yarn for a certain period after it has been cut.

The use of a clamp to retain the yarn, however, is not free from drawbacks, since management of the clamp is highly complicated because said clamp would have to retain only the elastic yarn without interfering with the other yarns. This problem is difficult to solve, since in many kinds of knitting the elastic yarn is dispensed together with other yarns.

The very presence of the clamp is undesirable, since it produces an extra bulk in the region of the machine above the needle cylinder, which is already crowded with a series of devices required for the correct operation of the machine.

Moreover, the retention of the yarn performed by the clamp may entail problems, since it can cause twisting of the various yarns that are fed to the machine.

These problems make it practically impossible to dispense more than one elastic yarn for each feed or drop of the machine, since if a plurality of elastic yarns were dispensed independently of each other, it would be necessary to use a clamp for each elastic yarn, consequently multiplying the above problems.

SUMMARY OF THE INVENTION

The aim of the present invention is to solve the above problems by providing a yarn feeder, particularly for elastic yarns having a high elongation coefficient, in circular knitting or hosiery-making machines, which is capable of ensuring, without requiring the use of clamps above the needle cylinder of the machine, the correct aspiration of the yarn by the suction port located above the dial.

Within the scope of this aim, an object of the invention is to provide a device which does not occupy extra space in the region of the machine located above the needle cylinder.

Another object of the invention is to provide a device which effectively avoids mutual twisting of the yarns fed to the machine.

Another object of the invention is to provide a device which is highly reliable in operation.

Another object of the invention is to provide a device which allows to supply, at a same drop or feed of the machine, a plurality of elastic yarns which can be managed independently of each other.

This aim, these objects and others which will become apparent hereinafter are achieved by a yarn feeder, particularly for elastic yarns having a high elongation coefficient, in circular knitting or hosiery-making machines, comprising a series of passages and/or contact regions forming a path for the yarn that unwinds from the spool or reel up to the needle work area of the machine, characterized in that it comprises, along said path, an element which can engage the yarn and can move on command in order to lengthen said path so as to produce an excess length of yarn unwound from said spool with respect to the length of yarn required by the machine and so as to supply at least part of said excess yarn directly before yarn cutting, which is performed proximate to the needle work area of the machine.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figures 1, 3:
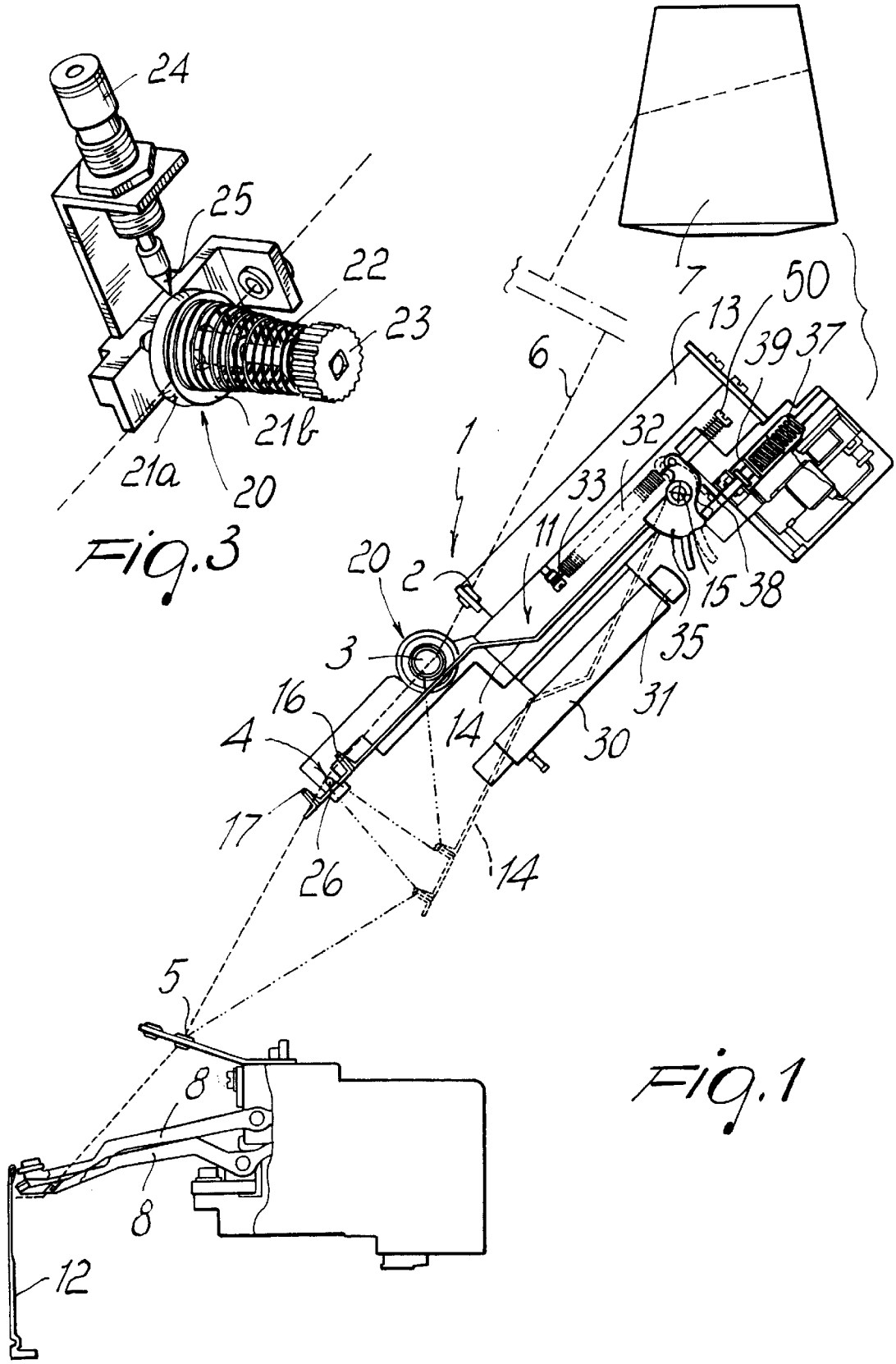
FIG. 1 is a schematic view of the device according to the present invention, applied to a single-cylinder hosiery-making machine.
FIG. 3 is a perspective view of a yarn braking device which can be used with the device according to the present invention.
Figure 2:
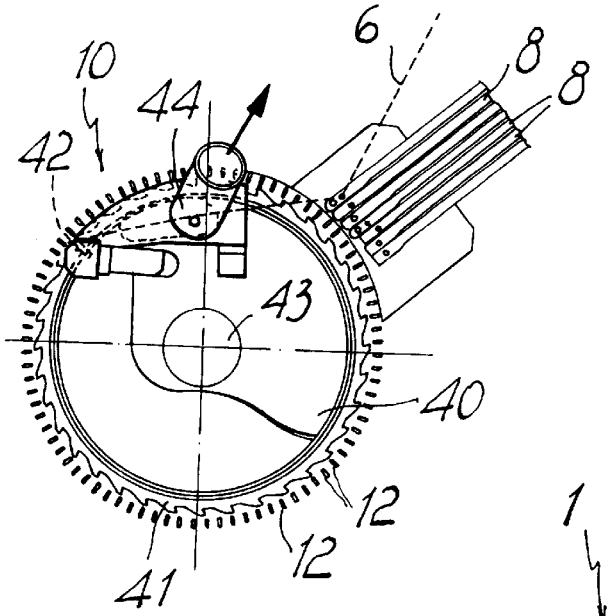
FIG. 2 is a schematic top plan view of the hosiery-making machine equipped with the device according to the present invention.
Figure 4:
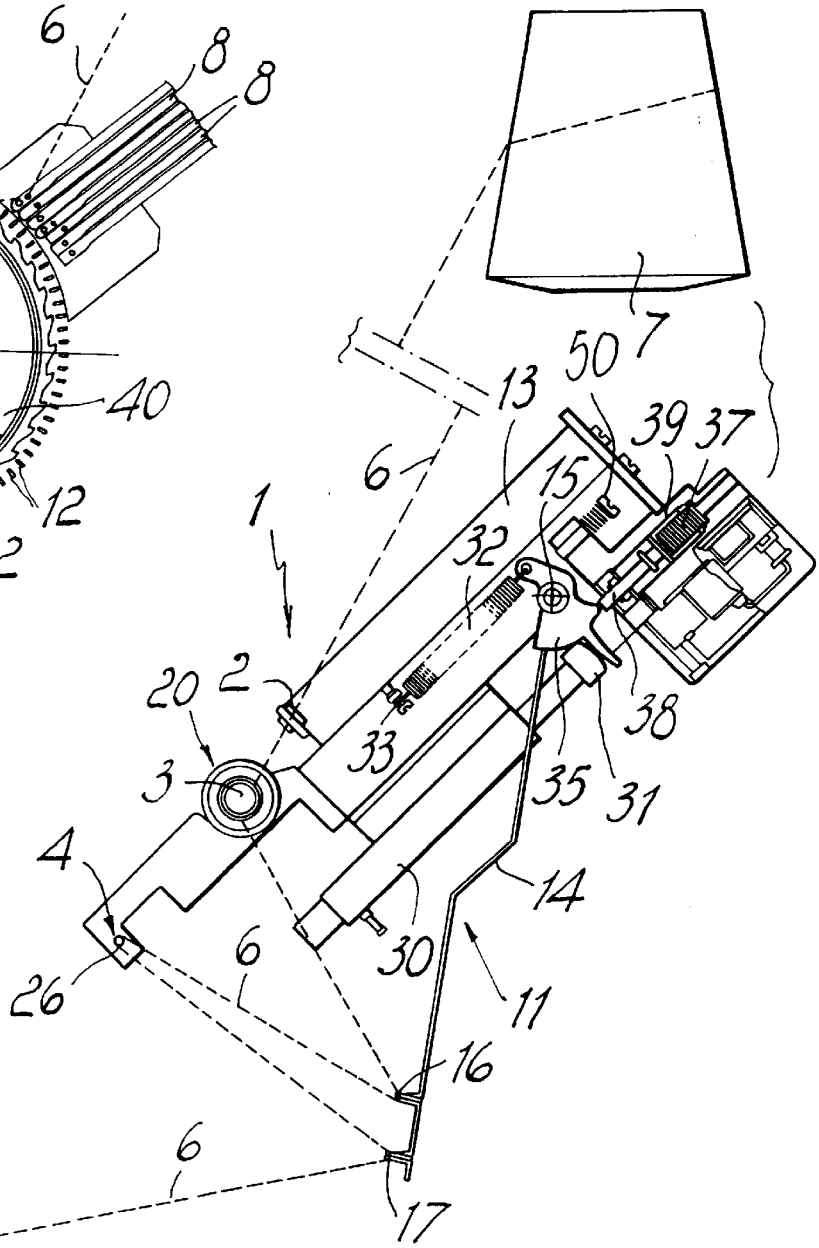
FIG. 4 is a view of the device according to the present invention in a different operating condition than shown in FIG. 1.
Figure 4:
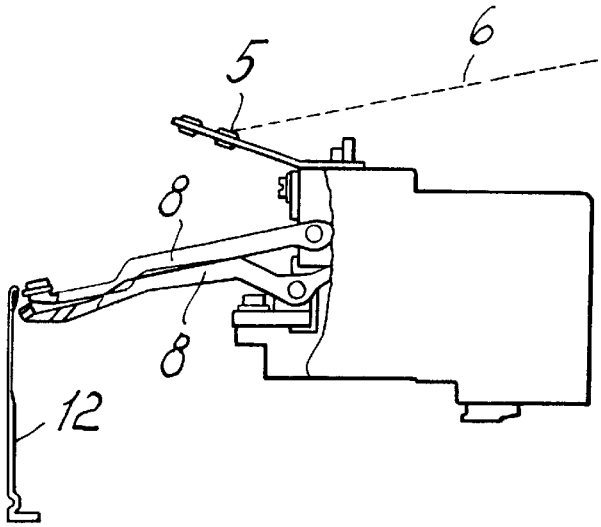

With reference to the above figures, the device according to the present invention, generally designated by the reference numeral 1, comprises a plurality of passages or contact regions, designated sequentially by the reference numerals 2, 3, 4 and 5, forming a path for the yarn 6 which unwinds from the spool 7 to the yarn fingers 8 located at a feed or drop of the knitting, hosiery-making machine, generally designated by the reference numeral 10.

The device according to the invention comprises, along the path formed by the passages or contact regions 2–5, an element 11 which can engage the yarn 6 and can move on command to lengthen the path followed by the yarn, so as to produce an excess length of the yarn unwound from the spool 7 with respect to the yarn length required by the machine 10 and so as to supply at least part of this yarn excess directly before yarn cutting, which is performed proximate to the work area of the needles 12 of the machine 10.

More particularly, the device according to the invention comprises a supporting structure 13 which is connected to the frame of the machine 10 and in turn supports the element 11, which is constituted by an arm 14 which is pivoted, at one of its ends, to the supporting structure 13 about an axis 15.

The arm 14 has also a first passage 16 for the yarn 6 in a region which is spaced from the axis 15.

Said first passage 16 is arranged between two fixed contact regions 3 and 4 for the yarn 6, which are arranged on the supporting structure 13.

The arm 14 can oscillate on command about the axis 15 to pass from a first position, in which it is arranged so that the first passage 16 is aligned with the fixed contact regions 3 and 4, to a second position, in which the passage 16 is shifted laterally with respect to the line that connects the two fixed contact regions 3 and 4 and viceversa.

In practice, as a consequence of the oscillation of the arm 14 about the axis 15, the first passage 16 is shifted in a direction which has a transverse component with respect to the axis of said passage 16.

The arm 14 has also, proximate to the end that lies opposite the end that is pivoted to the supporting structure 13 about the axis 15, a second passage 17 which is located downstream of the first passage 16 in the direction in which the yarn 6 advances towards the machine 10.

Both the first passage 16 and the second passage 17 are constituted by eyelets which are rigidly coupled to, or formed monolithically with, the arm 14.

The fixed contact region 3 is formed by a yarn braking device, generally designated by the reference numeral 20, which is substantially constituted by two circular plates 21*a* and 21*b* between which the yarn 6 passes.

The circular plate 21*b* is pushed towards the circular plate 21*a* by a spring 22, whose preloading can be adjusted by means of a suitable knob 23 in a per se known manner.

A fluid-driven cylinder, for example a pneumatic cylinder 24, is installed proximate to the two circular plates 21*a* and 21*b* and is supported by said supporting structure 13. The stem of the piston of the pneumatic cylinder 24 is fixed to a point 25, which faces the region that lies between the two circular plates 21*a* and 21*b* and which, by the actuation of the pneumatic cylinder 24, can be inserted between the two circular plates 21*a* and 21*b* so as to move the circular plate 21*b* away from the circular plate 21*a* in contrast with the action of the spring 22 to release or substantially reduce the braking action applied by the two circular plates 21*a* and 21*b* on the yarn 6.

The other fixed contact region 4 is constituted by a resting pin 26 which, when the arm 14 is in the first mentioned position, is located between the two passages 16 and 17 of the arm 14. When the arm 14 is moved, as a consequence of its oscillation about the axis 15, from the first position to the second position, the pin 26 stretches the yarn 6 in the region between the two passages 16 and 17 of the arm 14.

The oscillation of the arm 14 about the axis 15 to transfer said arm from the first position to the second position is partly achieved by way of a spring 32, which is connected, with one of its ends, to a fixed retention element 33 which is rigidly coupled to the supporting structure 13 and is connected, with its other end, to a rocker 35 which is rigidly coupled to the end of the arm 14 that is pivoted about the axis 15, and partly achieved by means of a fluid-driven cylinder 30, which is fitted on the supporting structure 13 and acts with the stem of its piston, which is provided with a suitable head 31, on said rocker 35 which is rigidly coupled to the arm 14.

In order to achieve a partial oscillation of the arm 14 about the axis 15, stopping in a position which is intermediate between the first position and the second position, the fluid-driven cylinder 30 is not actuated and the oscillation occurs only due to the spring 32.

Advantageously, means are provided for retaining and returning the arm 14 in the first position; said means comprise a fluid-driven cylinder 39 which is mounted on the supporting structure 13; the stem 38 of the piston of said cylinder 39 faces a portion of the rocker 35 of the arm 14.

The fluid-driven cylinder 39 can be constituted, as shown, by a single-action pneumatic cylinder which, when actuated, moves away, with the stem 38 of its piston, from the rocker 35, leaving the arm 14 free to oscillate in order to move from the first position to the second position and which, when it is not actuated and therefore discharged, retains or pushes the arm 14 in the first position as a consequence of the elastic reaction of its return spring 37.

It should be observed that when the arm 14 is in the first position, a portion of said arm 14 can engage between the circular plates 21*a* and 21*b*, substantially eliminating the braking of the yarn 6, while when the arm 14 moves from the first position the circular plates brake the yarn 6 unless the pneumatic cylinder 24 is actuated so as to still keep the circular plates 21*a* and 21*b* spaced apart.

In order to prevent the arm 14 in the first position from eliminating the braking effect of the plates 21*a* and 21*b*, it is possible to act on an adjustment screw 50, against which the rocker 35 engages; said screw delimits the extent of the oscillation of the arm 14 about the axis 15 in the direction of the oscillation produced by the elastic reaction of the spring 37 of the fluid-driven cylinder 39.

For the sake of completeness in description, it should be observed that the machine 10 is equipped, in a per se known manner, with a dial 40 which has a cutter 41. A knife 42 is installed in a per se known manner above the dial 40 and is angularly spaced, around the axis 43 of the needle cylinder of the machine 10, with respect to the yarn feeding region whereat the yarn fingers 8 are arranged. A suction port 44 is arranged between the regions where the knife 42 and the yarn fingers 8 are located, above the dial 40.

The operation of the device according to the invention is as follows.

During the feeding of the yarn 6, the arm 14 is arranged in the first position, i.e., so that the first passage 16 is aligned with the fixed contact regions 3 and 4 and so that a portion thereof is optionally wedged between the circular plates 21*a* and 21*b* of the yarn braking device 20. The arm 14 is kept in this position by the spring 37 of the fluid-driven cylinder 39 which is discharged. In this manner, the yarn 6 is dispensed normally to the needles 12 of the machine 10 through the corresponding yarn finger 8.

Just before cutting the yarn 6 by means of the combined action of the knife 42 and of the cutter 41, the fluid-driven cylinder 39 is actuated and releases the arm 14, leaving it free to oscillate about the axis 15 through the action of the spring 32. Simultaneously, the fluid-driven cylinder 30 is also actuated and completes the oscillation of the arm 14 about the axis 15, moving it into the second position. The pneumatic cylinder 24 is actuated immediately before the actuation of the fluid-driven cylinder 39 and deactivates the yarn braking device 20 so that the transfer of the arm 14 from the first position to the second position causes a takeup or accumulation of yarn along the path followed by said yarn, unwinding from the spool 7 an amount of yarn 6 which is greater than the amount actually required by the machine 10. Directly before actuating the knife 42, i.e., when the yarn 6 is stretched between the knife 42 and the corresponding yarn finger 8, below the suction port 44, the fluid-driven cylinder 39 and the fluid-driven cylinder 30 are discharged so that the arm 14 is returned to the first position by the elastic reaction of the spring 37. In this manner, when the yarn 6 is cut by the combined action of the knife 42 and of the cutter 41, there is an excess of thread 6 which makes it easier for the suction port 44 to aspirate the yarn 6 and thus effectively avoids the disengagement of the yarn 6 by retraction. In this manner, the yarn 6, directly after cutting, is correctly retained by the suction of the port 44.

It should be observed that the arm 14 can also take up an excess yarn fed previously to the machine 10. This requirement can occur for example during the reciprocating actuation of the needle cylinder about its own axis 43, for example during the forming of the heel of socks or stockings. This effect is achieved by actuating the fluid-driven cylinder 39 so as to free the arm 14, which oscillates about the axis 15 and moves into a position which is intermediate between the first position and the second position through the action of the spring 32 alone. In this case, the arm 14 takes up the yarn 6 from the machine and does not take it up from the spool 7, since the oscillation of the arm 14 due to the action of the spring 32 causes the mutual approach of the two circular plates 21*a* and 21*b*, which brake the yarn 6 ahead of the passage 16, since the pneumatic cylinder 24 is not actuated.

In practice it has been observed that the device according to the invention fully achieves the intended aim, since it allows to achieve correct suction and retention of elastic yarns having a high elongation coefficient inside the suction port after cutting, avoiding escape from the yarn fingers and thus ensuring correct operation of the machine when the dispensing of said yarn resumes, without however requiring the use of clamps or of other devices which might cause problems in terms of bulk or interference with other devices above the dial of the machine.

Another advantage of the device according to the invention is that it allows to independently dispense multiple elastic yarns at a single feed or drop of the machine.

The device thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

What is claimed is:

1. In a circular knitting machine including a frame, a needle work area and a yarn cutting area, said yarn cutting area being located proximate to said needle work area, a yarn feeder, particularly for an elastic yarn unwound from a spool and having a high elongation coefficient, said feeder comprising: a series of passages with yarn contact regions, said passages forming a path for the yarn that unwinds from the spool up to the needle work area of the machine; an engagement element located along said yarn path for engaging the yarn; and means for moving said engagement element on command in order initially to lengthen said yarn path so as to produce an excess length of yarn unwound from said spool with respect to a length of yarn required by the machine during knitting and so as to subsequently at least reduce said yarn path so as to supply at least part of said excess yarn directly before the yarn cutting area.

2. The feeder of claim 1, wherein said engagement element comprises: an arm; a supporting structure being mounted on the frame of the machine; a fulcrum at which said arm is pivoted, with a portion thereof, to the supporting structure; a first passage for the yarn being provided on said arm in a region which is spaced from the fulcrum and defining a passage axis thereof, said arm being oscillatable on command about said fulcrum in order to shift said first passage in a direction having a transverse component with respect to the passage axis of said passage.

3. The feeder of claim 2, wherein said first passage is arranged between two of said contact regions for the yarn which are located on said supporting structure.

4. The feeder of claim 3, comprising, between said first passage and the spool, a yarn braking device which is deactivatable on command.

5. The feeder of claim 4, wherein said arm is movable on command, by oscillating about said fulcrum, from a first position, in which said first passage is substantially aligned with said two contact regions, to a second position, in which said first passage is shifted laterally with respect to a line that connects said two contact regions, and viceversa.

6. The feeder of claim 5, wherein a first one of said two contact regions is located ahead of said first passage in a yarn feed direction, and is formed by said yarn braking device.

7. The feeder of claim 6, wherein a second yarn passage is provided at said arm, said second passage being arranged after said first passage in the yarn feed direction.

8. The feeder of claim 7, wherein a second one of said two contact regions is located, when said arm is in said first position, between said first yarn passage and said second yarn passage.

9. The feeder of claim 8, wherein the second one of said two contact regions is in a position adapted for stretching the yarn between said first passage and said second passage, when said arm is in said second position.

10. The feeder of claim 5, comprising first and second actuation means, said arm being oscillatable about said fulcrum by action of said first actuation means and second actuation means.

11. The feeder of claim 10, comprising returning means for retaining in, or returning said arm to said first position.

12. The feeder of claim 11, wherein said returning means comprises a further fluid-driven cylinder, said further fluid-driven cylinder being connected to said supporting structure and acting on said arm to oscillate the arm about said fulcrum in the opposite direction with respect to the oscillation produced by said first actuation means and said second actuation means.

13. The feeder of claim 5, wherein said arm, in said first position, deactivates said yarn braking device.

14. The feeder of claim 10, wherein said first actuation means comprises a spring, said spring acting on said arm to make the arm oscillate about said fulcrum from said first position to a further position which is intermediate between said first position and said second position.

15. The feeder of claim 14, wherein said second actuation means comprises a fluid-driven cylinder, said fluid-driven cylinder being actuatable on command for acting on said arm to move the arm from said intermediate position to said second position.

16. The feeder of claim 4, wherein said yarn braking device comprises: two circular plates between which the yarn passes; elastic means; and a fluid-driven cylinder being actuatable on command for mutually spacing said two circular plates which are pressed against each other by said elastic means.

17. The feeder of claim 16, wherein said arm, in said first position, wedges with a portion thereof between said two circular plates of the yarn braking device.

18. In a circular knitting machine including a frame, a needle work area and a yarn cutting area located proximate to said needle work area, a method for feeding a yarn unwound from a spool to the needle work area by means of a feeder, comprising the steps of:

unwounding the yarn from the spool and passing said yarn through a series of passages with yarn contact regions, along a yarn path;

before cutting said yarn, lengthening said yarn path so as to produce an excess length of yarn unwound from said spool with respect to the length of yarn required by the machine during a knitting operation;

at least reducing said yarn path before cutting said yarn in the yarn cutting area; and supplying at least part of said excess length of yarn directly before said yarn cutting area; said excess length of yarn allowing to perform a cutting operation of said yarn avoiding retraction of the yarn and disengagement thereof.

* * * * *